US009297613B2

(12) United States Patent
Maentymaa

(10) Patent No.: US 9,297,613 B2
(45) Date of Patent: Mar. 29, 2016

(54) METHOD FOR MANUFACTURING SIGHT FRAME ATTACHABLE TO HANDGUN AND SIGHT FRAME ATTACHABLE TO HANDGUN

(71) Applicant: Timo Maentymaa, Ypaejae (FI)

(72) Inventor: Timo Maentymaa, Ypaejae (FI)

( * ) Notice: Subject to any disclaimer, the term of this patent is extended or adjusted under 35 U.S.C. 154(b) by 71 days.

(21) Appl. No.: 13/796,625

(22) Filed: Mar. 12, 2013

(65) Prior Publication Data

US 2013/0247440 A1 Sep. 26, 2013

(30) Foreign Application Priority Data

Mar. 15, 2012 (FI) ..... 20125288

(51) Int. Cl.
*F41G 1/00* (2006.01)
*F41G 11/00* (2006.01)
*F41C 23/12* (2006.01)

(52) U.S. Cl.
CPC . *F41G 1/00* (2013.01); *F41C 23/12* (2013.01); *F41G 11/003* (2013.01); *Y10T 29/49826* (2015.01)

(58) Field of Classification Search
CPC ..... F41C 23/04; F41C 23/10; F41C 23/12; F41C 33/0245; F41G 1/00; F41G 11/003
USPC ..... 42/111, 71.01–73
See application file for complete search history.

(56) References Cited

U.S. PATENT DOCUMENTS 4,291,482 A 9/1981 Bresan
4,601,123 A * 7/1986 Swearengen et al. ..... 42/72
4,601,723 A * 7/1986 McGrew ..... 623/10
6,318,014 B1 11/2001 Porter
8,887,432 B2 * 11/2014 Oz ..... 42/71.02
2005/0235546 A1 * 10/2005 Wonisch et al. ..... 42/75.01
2009/0282718 A1 11/2009 Bartley
2011/0088305 A1 * 4/2011 Oz ..... 42/69.01
2011/0107644 A1 5/2011 Faifer

FOREIGN PATENT DOCUMENTS

EP 2 314 976 A2 4/2011

OTHER PUBLICATIONS

Search Report issued in Finnish Patent Application No. 20125288 dated Nov. 26, 2012 (with translation).
Oct. 15, 2015 Search report issued in European Application No. 13159171.1.

* cited by examiner

*Primary Examiner* — Stephen M Johnson
*Assistant Examiner* — Benjamin Gomberg
(74) *Attorney, Agent, or Firm* — Oliff PLC

(57) ABSTRACT

A sight frame with which the user can convert a handgun into a rifle-like gun is disclosed. The sight frame includes a frame part and stock, as well as an intermediate slide and locking and guide structures in such a manner that said locking and guide structures are arranged on the sight frame for fast attachment to a handgun and that said intermediate slide is by means of the lifting force provided by the locking and guide structures to the handgun arranged to support itself play free against the slide of the handgun along a major portion of the slide and to support itself through the guide surfaces play free against the guide surfaces arranged on the frame part of the sight frame.

11 Claims, 10 Drawing Sheets

METHOD FOR MANUFACTURING SIGHT FRAME ATTACHABLE TO HANDGUN AND SIGHT FRAME ATTACHABLE TO HANDGUN

FIELD OF THE INVENTION

The invention relates to arms technology and the manufacturing technique of arms and especially to a method for manufacturing a sight frame attachable to a handgun, and to a sight frame attachable to a handgun. The invention relates to a sight frame which is attachable to a handgun and with which sight frame the user can convert the handgun into a rifle-like gun. With the sight frame according to the invention, the user obtains a handgun converted into a rifle that is more precise and reliable than the earlier solutions.

BACKGROUND OF THE INVENTION

All pistols are intended to be short-range guns. Hitting a target precisely and surely with a pistol from a distance of 30 metres, for instance, requires incredible shooting skills from the user. If the situation also causes physical or mental stress, hitting the target is very improbable. In long-range shooting, the weapon used is usually a rifle-like gun with a stock.

The object of the invention is to provide a sight frame equipped with a folding stock and attachable to a handgun, which can be attached to a pistol very quickly without loose parts and whose rigid connection to the pistol slide is as play free as possible and completely unidirectional. The object of the sight frame according to the invention is to provide optimum precision for a handgun.

The sight frame attachable to a handgun and equipped with a folding stock according to the invention is primarily intended for fast increase in the operating capacity of a side-arm (pistol) of law enforcers and certain type of army forces as required. An advantage of the solution according to the invention is that if there is in a police patrol car such a sight frame equipped with a folding stock and a criminal manages to take or steal it, the sight frame without the pistol in the possession of the police does not create any threat against the police or civilians. The sight frame attachable to a handgun and equipped with a folding stock according to the invention is thus safer than an ordinary weapon equipped with a stock (such as a rifle, for instance) suitable for more demanding situation and carried by the police.

The sight frame attachable to a handgun has four fastening rails, on which the necessary sighting devices can be mounted. One fastening rail is on top for an optical sight, and one fastening rail is directly below the barrel line and suitable for laser units or lighting units, for example. Two of the fastening rails are on both sides of the barrel line; one for fastening a front handle, for instance, and the other for some other additional device.

The fastening rail directly above or below the barrel line is in an optimum location in comparison with having a laser sight on the side of the barrel line. The lines of the barrel and sight then do not cross in the sideways direction, which is even more important as the distance grows. When using the fastening rail directly above or below the barrel line, the only line deviation is caused by the ballistic properties of the cartridge, that is, the trajectory, which is considerably easier for the shooter to take in to consideration.

Prior-art sight frames attachable to a handgun are described in patent publications EP 2314976A2, US 2009/0282718A1, US 2011/0107644A1 and U.S. Pat. No. 6,318,014 B1, for example.

The prior-art sight frame solutions are difficult to attach to a handgun. In the prior-art sight frame solutions, the precision achieved with the handgun is not sufficient.

Thus, there is an obvious need for a sight frame attachable to a handgun, by means of which the user obtains a handgun that is converted into a rifle and is more precise and reliable than the earlier solutions.

BRIEF DESCRIPTION OF THE INVENTION

It is an object of the invention to provide a novel method for manufacturing a sight frame attachable to a handgun and a novel sight frame attachable to a handgun.

The method of the invention for manufacturing a sight frame attachable to a handgun, which method comprises the manufacture of a frame part and stock part of the sight frame, is characterised in that the method also comprises the manufacture of an intermediate slide and locking and guide structures of the sight frame in such a manner that:

- said locking and guide structures are arranged on the sight frame for fast attachment to the handgun, and
- said locking and guide structures are manufactured to produce in the handgun a lifting force, and guide surfaces are manufactured to said frame part and intermediate slide of the sight frame in such a manner that the intermediate slide is, by means of the lifting force provided by the locking and guide structures to the handgun, arranged to support itself play free against the slide of the handgun along a major portion of the length of the slide, and to support itself through its guide surfaces play free against the guide surfaces arranged on the frame part of the sight frame.

The sight frame of the invention that is attachable to a handgun and comprises a frame part and stock part is characterised in that said sight frame also comprises an intermediate slide and locking and guide structures in such a manner that:

- said locking and guide structures are arranged on the sight frame for fast attachment to the handgun, and
- said intermediate slide is, by means of the lifting force provided by the locking and guide structures to the handgun, arranged to support itself play free against the slide of the handgun along a major portion of the length of the slide, and to support itself through its guide surfaces play free against the guide surfaces arranged on the frame part of the sight frame.

An improved solution for manufacturing a sight frame attachable to a handgun and an improved sight frame solution attachable to a handgun have now been developed. The solution is characterised by what is stated in the independent claims. Some preferred embodiments of the invention are disclosed in the dependent claims.

BRIEF DESCRIPTION OF THE FIGURES

Some embodiments of the invention will now be described in greater detail by means of some preferred embodiments, with reference to the attached drawings, in which.

DETAILED DESCRIPTION OF AN EMBODIMENT OF THE INVENTION

The sight frame solution of the invention uses an intermediate slide that permits a play free and fully unidirectional connection between the slide of the pistol and the sight frame. In the solution of the invention, the pressure that keeps the slide of the gun against the intermediate slide and the intermediate slide against the slide surfaces of the sight frame is generated by a spring that uses a turning/locking piece characteristic of the sight frame according to the invention.

Figure 1:
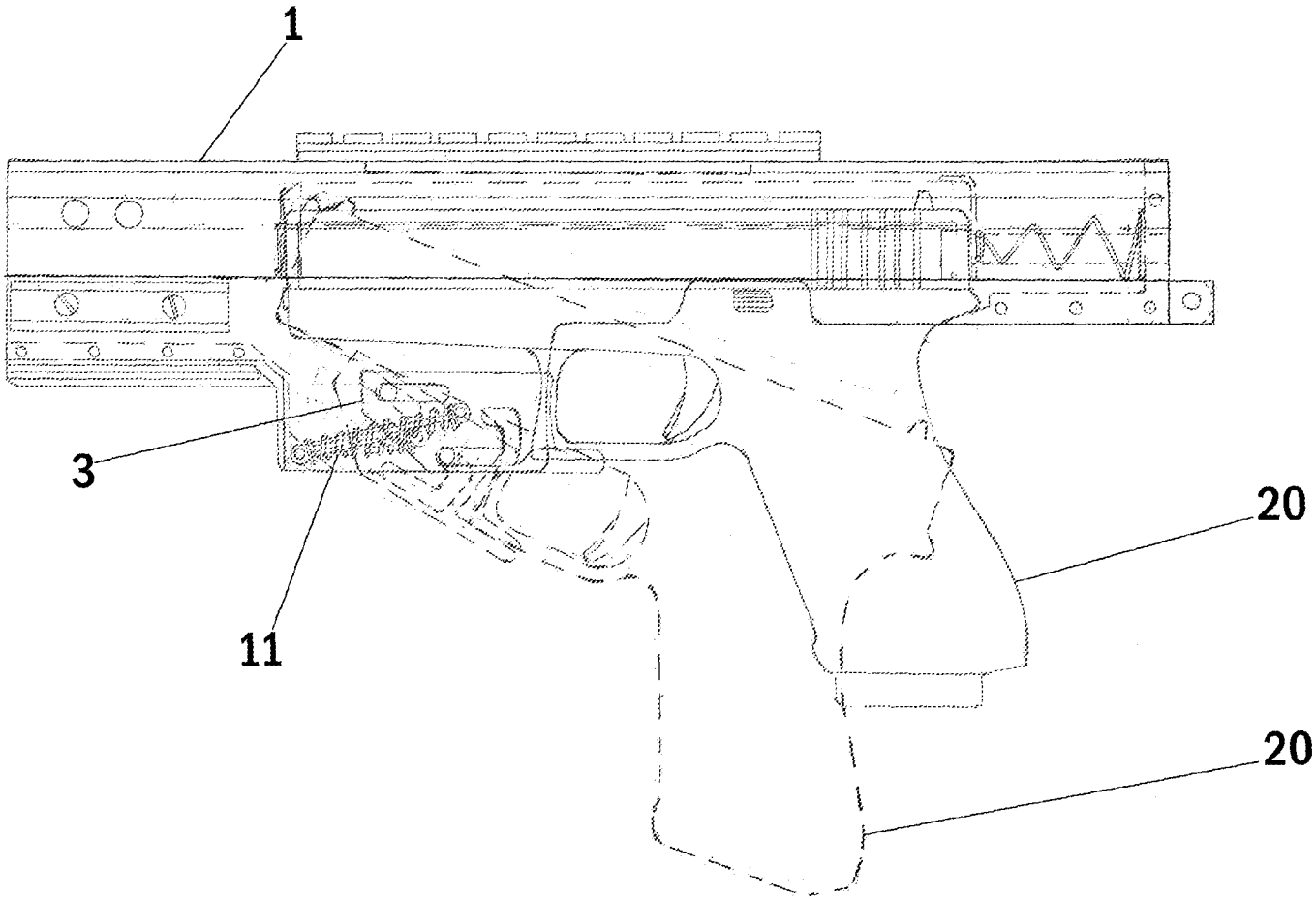
FIG. 1 shows how a handgun is attached to a sight frame according to the invention.

FIG. 1 shows the attachment of a handgun to a sight frame according to the invention. In FIG. 1, the sight frame is indicated by number 1, the turning/locking piece of the sight frame by number 3, the operating spring of the turning/locking piece by number 11 and the handgun by number 20. In FIG. 1, a dashed line shows how the handgun 20 is inserted into the sight frame 1, and a uniform line how the handgun 20 is in its operating position in the sight frame.

Figure 2:
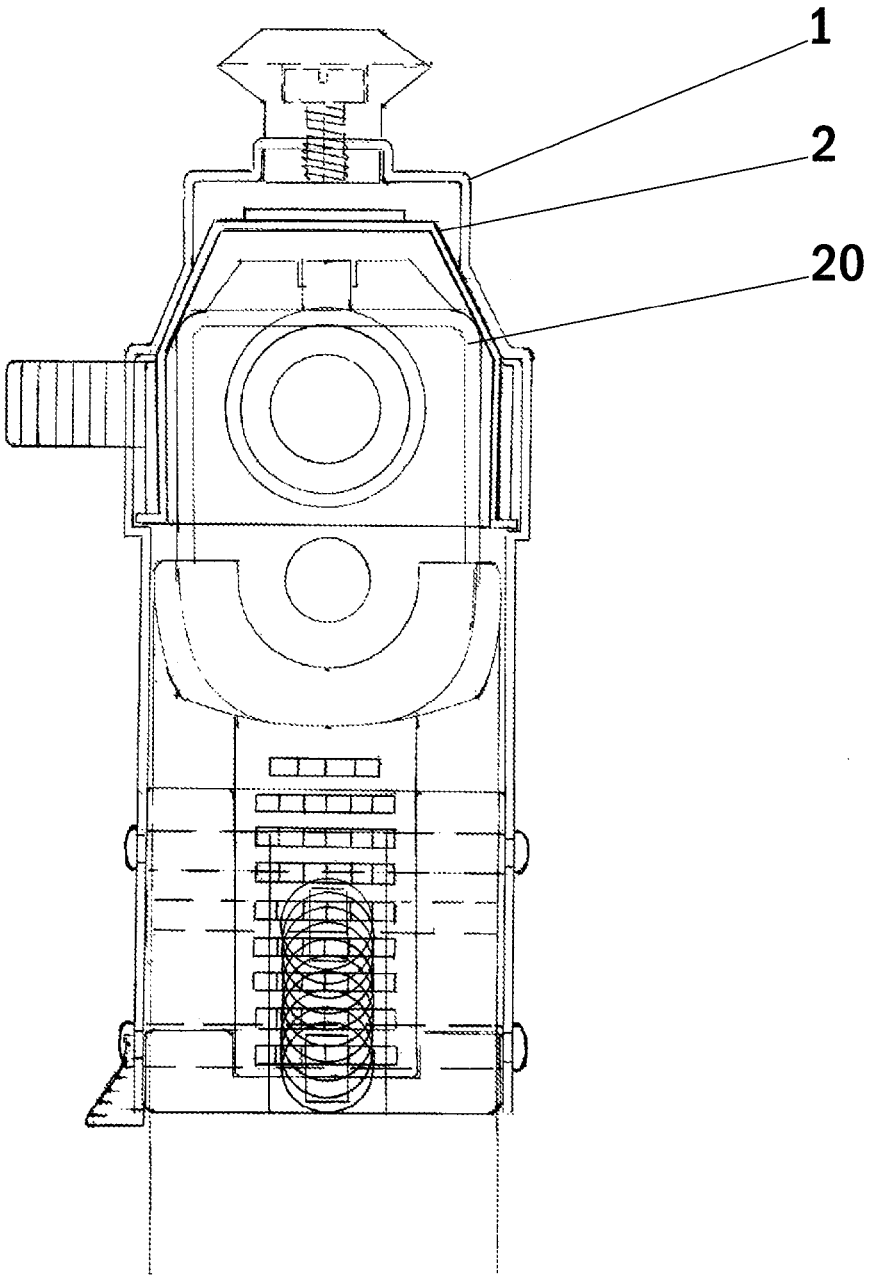
FIG. 2 shows a sight frame according to the invention attached to a handgun as a cutaway view from the front.

FIG. 2 shows a sight frame according to the invention attached to a handgun as a cutaway view from the front. In FIG. 2, the sight frame is indicated by number 1, the intermediate slide of the sight frame by number 2, and the handgun by number 20. FIG. 2 shows the play free rigid connection between the slide, intermediate slide 2 and sight frame 1 of a handgun 20, such as a pistol, when the pistol is in its operating position on the sight frame according to the invention.

Figure 3:
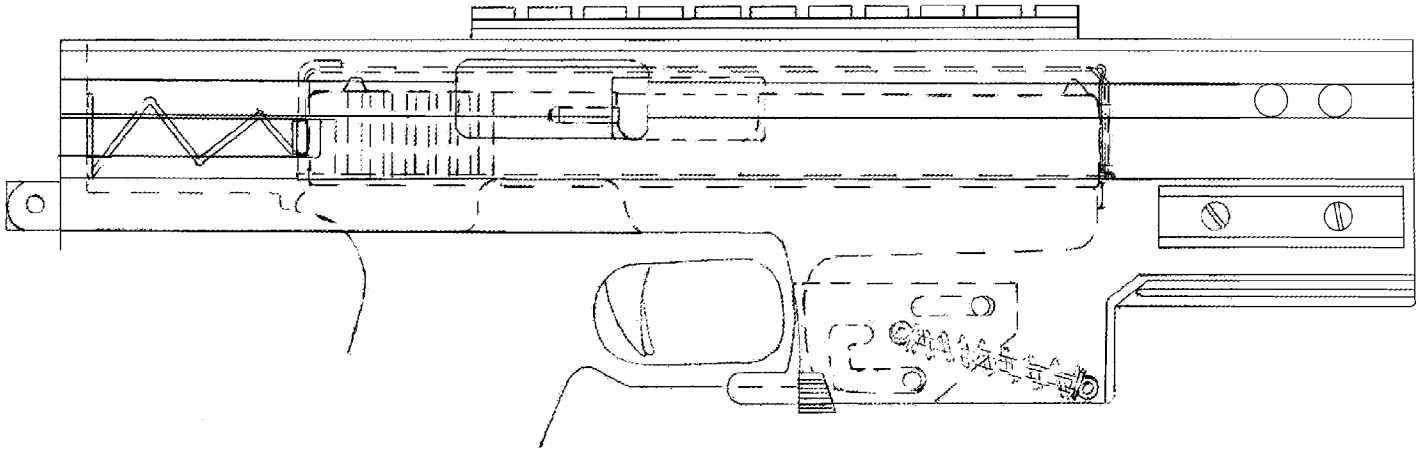
FIG. 3 shows a sight frame according to the invention attached to a handgun as seen from the side.

FIG. 3 shows a sight frame according to the invention attached to a handgun as seen from the side. FIG. 3 shows clearly the handgun in its operating position on the sight frame according to the invention as seen from the side of the release/load openings.

Figure 4:
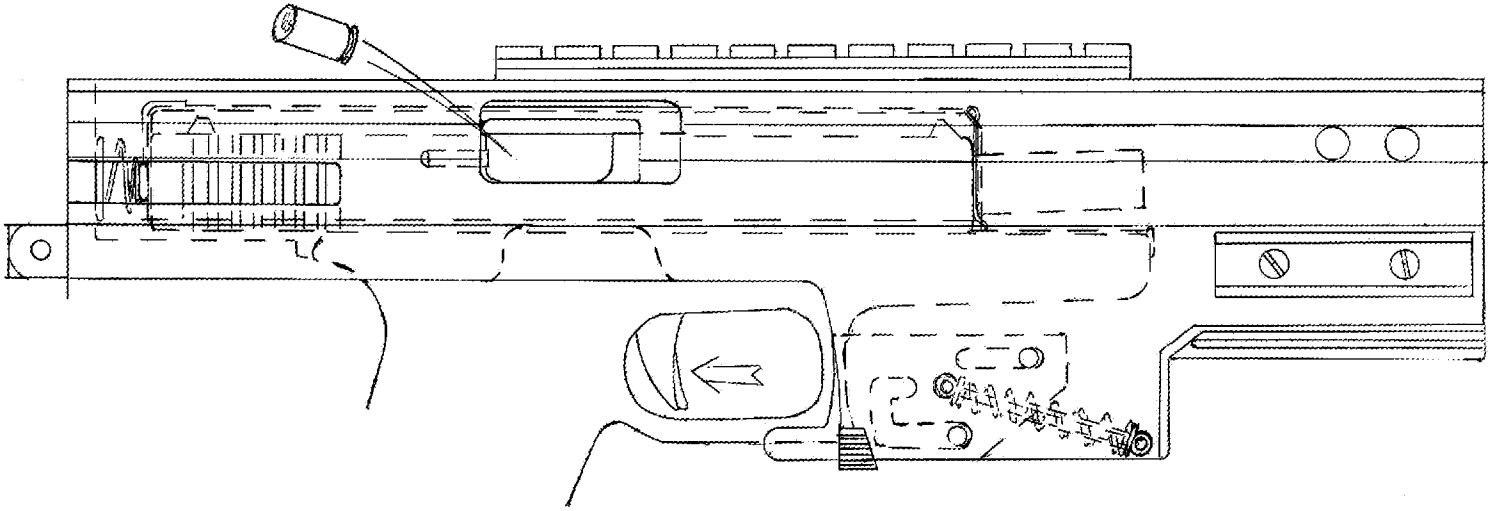
FIG. 4 shows a handgun attached to a sight frame according to the invention as seen from the side after firing.

FIG. 4 shows a handgun attached to a sight frame according to the invention from the side after firing. FIG. 4 shows how after firing the slides have retracted and the casing of the round flies out through the openings made for it in the intermediate slide and sight frame.

Figure 5:
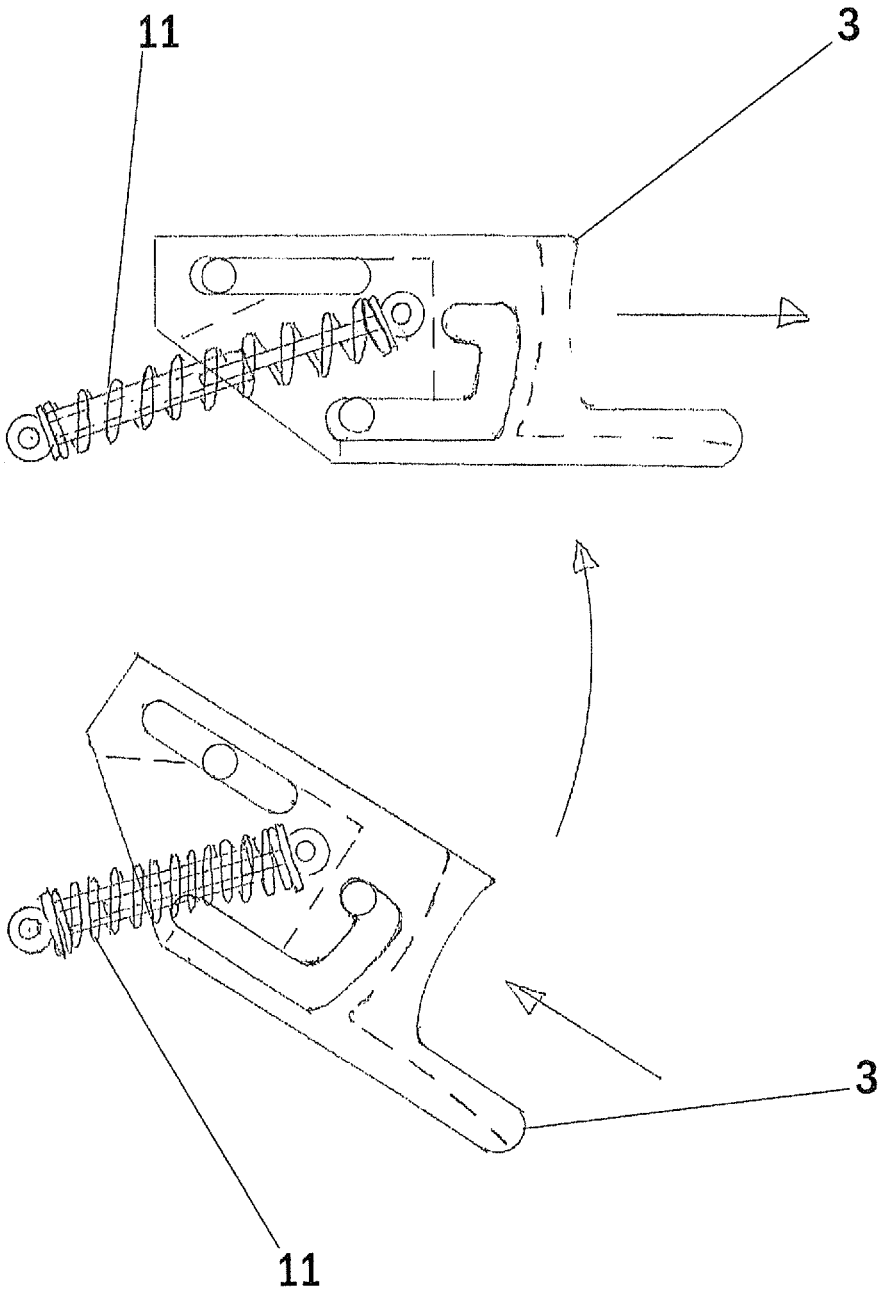
FIG. 5 shows a turning/locking piece of a sight frame according to an invention as well as its operation.

FIG. 5 shows a turning/locking piece of a sight frame according to the invention as well as its operation. In FIG. 5, the turning/locking piece of the sight frame is indicated by number 3 and the operating spring of the turning/locking piece by number 11. FIG. 5 shows clearly the paths of the turning/locking piece 3 of the sight frame, which are defined by the guide axles of the turning/locking piece 3 fastened to the sight frame and along which the turning/locking piece 3 moves thanks to its grooves. FIG. 5 also shows clearly the operating spring 11 of the turning/locking piece with its frame parts in different positions as well as the space made for the operating spring 11 of the turning/locking piece inside the turning/locking piece 3.

Figure 6:
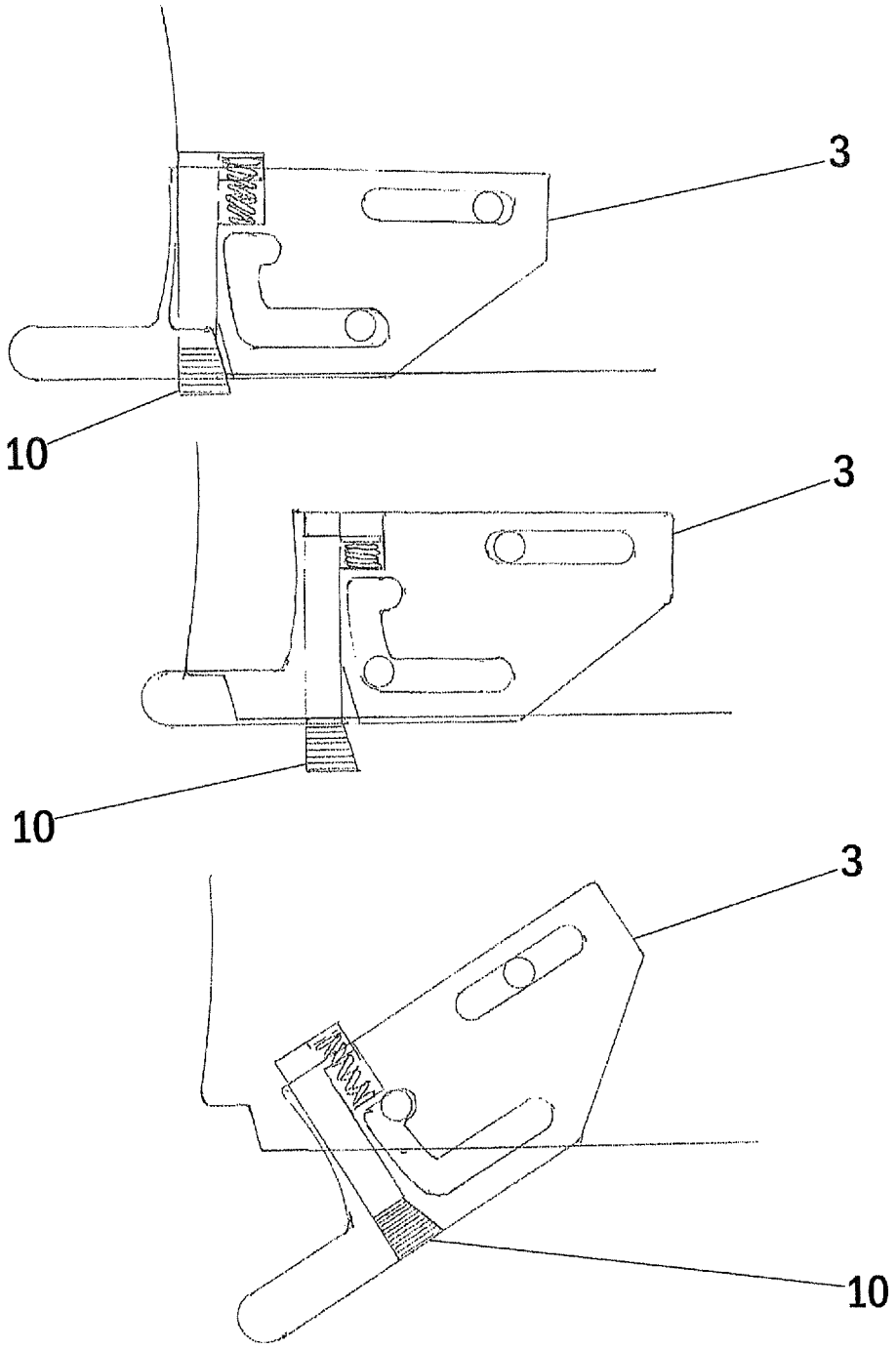
FIG. 6 shows a locking/release claw of the operating position of a turning/locking piece of a sight frame according to an invention as well as its operation.

FIG. 6 shows a locking/release claw of the operating position of the turning/locking piece of a sight frame according to the invention as well as its operation. In FIG. 6, the turning/locking piece of the sight frame is indicated by number 3 and the locking/release claw of the operating position of the turning/locking piece by number 10. FIG. 6 clearly shows the locking/release claw 10 of the operating position of the turning/locking piece of the sight frame and its springs in different positions of the turning/locking piece 3. FIG. 6 also clearly shows the locking notch for the locking/release claw 10 of the operating position of the turning/locking piece in the sight frame.

When the handgun 20, such as a pistol, is placed on the sight frame 1 in the solution of the invention, the trigger guard of the pistol 20 is positioned in the notch intended for it in the turning/locking piece 3. The pistol 20 is pushed slightly forward until a lower guide axle of the turning/locking piece in the sight frame 1 releases from the notch of a guide groove in the turning/locking piece 3, which permits an open position. Now the turning/locking piece 3 begins to turn upward along a path made possible by grooves guiding it. The force that in the solution of the invention turns and finally pushes the turning/locking piece 3 backward into a locking position is generated by the operating spring 11 of the turning/locking piece. The operating spring 11 of the turning/locking piece is at its operating spring 11 frame side end mounted turnably to the frame of the turning/locking piece 3 and at its other end to the sight frame 1.

When the turning/locking piece 3 turns parallel to the intermediate slide of the sight frame, the turning/locking piece 3 starts automatically to move backward along the grooves in the turning/locking piece 3 under the force generated by the operating spring 11 of the turning/locking piece. At the same time, a rear ramp on the top part of the pistol 20 handle comes against a ramp surface on the sight frame and lifts the rear part of the pistol 20 upward. The slide of the pistol 20 then rises to be in contact with the intermediate slide 2 of the sight frame, and the slide surfaces of the intermediate slide 2 rise to be in contact with the slide surfaces of the sight frame 1. Because the lower guide groove of the turning/locking piece 3 is slightly loose, it permits the lifting force acting on the lower surface of the trigger guard to keep the entire slide of the pistol 20, even the front part of the slide, play free on the intermediate slide 2 by spring force. The same lifting force that acts on the lower surface of the trigger guard also keeps the intermediate slide 2 by means of its oblique guide surfaces and through the oblique guide surfaces of the sight frame 1 in play free contact with the sight frame, which allows for optimum precision at distances that are many times longer than when using just a pistol.

As the turning/locking piece 3 arrives at its retracted position, the locking/release claw 10 of the operating position of the turning/locking piece rises to the oblique surface on the sight frame 1 along a corresponding oblique surface on the locking/release claw 10 and keeps the pistol 20 in place on the sight frame 1 until the pistol is detached from the sight frame 1. When detaching the pistol 20, the locking/release claw 10 of the operating position of the turning/locking piece is pressed down and the pistol 20 is pushed first forward, then downward and finally slightly backward on the sight frame 1. The turning/locking piece 3 then remains in its open position on the notch of the guide groove and suspended by the guide axle on the sight frame, and the pistol 20 may be pulled completely away from the sight frame 1 and the turning/locking piece 3 remains in a correct position for the next instance of use.

Figure 7:
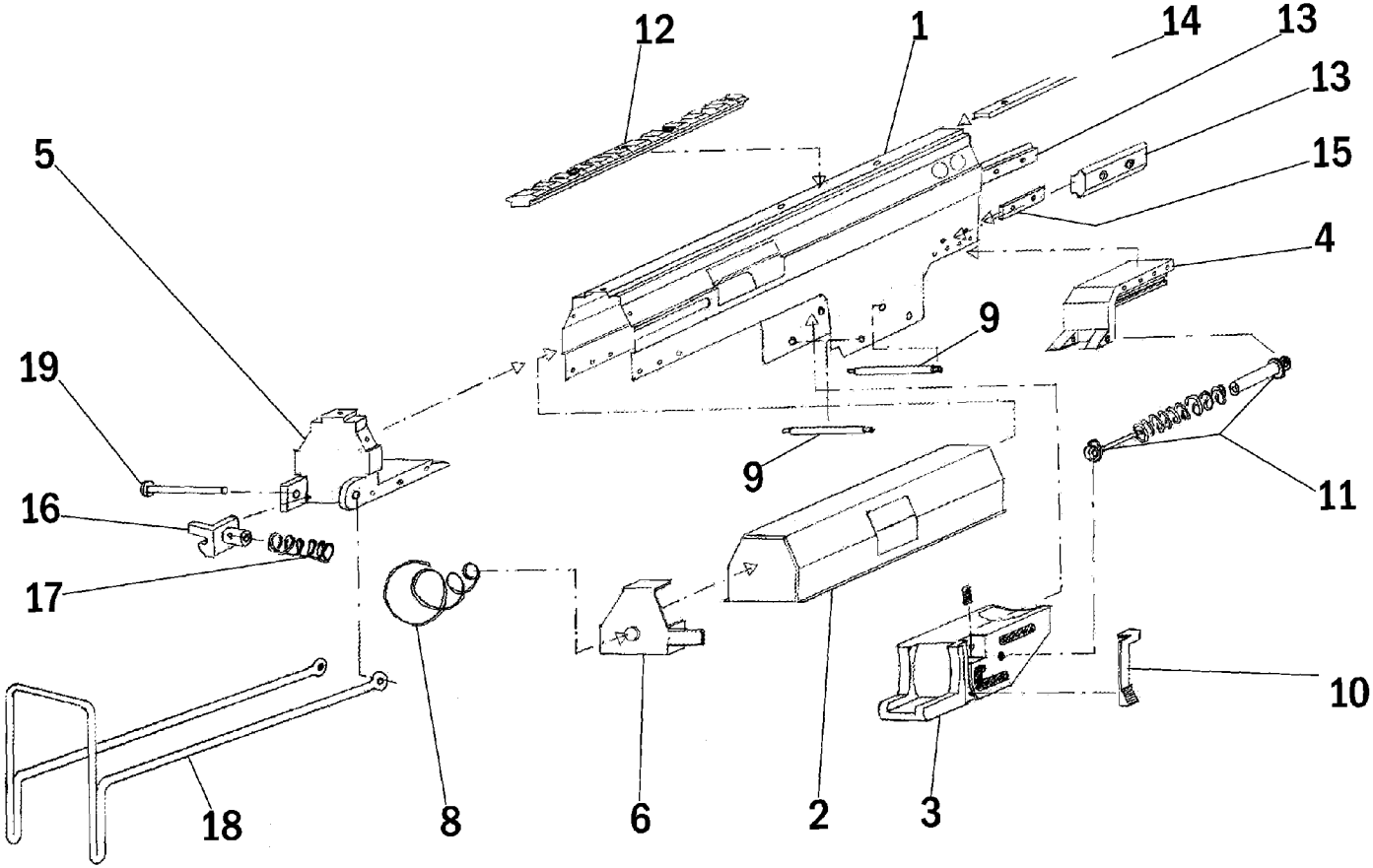
FIG. 7 shows a sight frame according to the invention attached to a handgun as an exploded view.

FIG. 7 shows a sight frame according to the invention attached to a handgun as an exploded view. FIG. 7 shows clearly the essential components of the sight frame attachable to a handgun according to the invention. A sight frame attached to a handgun according to the invention comprises a main frame 1, intermediate slide 2, turning/locking piece 3, front piece 4, rear piece 5, support/cocking piece 6 of the intermediate slide, retainer/return spring 8, guide axles 9 of the turning/locking piece, locking/release claw 10 of the operating position of the turning/locking piece, operating spring 11 of the turning/locking piece, top fastening rail 12 of the sight frame, side fastening rails 13 of the sight frame, locking counter-piece 14 of the top fastening rail, locking counter-pieces 15 of the side fastening rails, locking/release sleeve 16 of the folding stock, operating spring 17 of the locking/release sleeve of the folding stock, folding stock 18, and turning axle pin 19 of the folding stock.

The main frame 1 of the sight frame has a guiding slide surface with an angle that is arranged to be the same as the corresponding guiding slide surface on the intermediate slide. The guiding slide surface of the main frame 1 of the sight frame is large enough that pressure arriving at it through the guiding slide surface of the intermediate slide is distributed on a sufficient surface area to endure wear and heat caused by friction. The main frame 1 of the sight frame also preferably has fastening holes for the guide axles 9 of the turning/locking piece 3 and a groove arranged on the support/cocking piece 6 of the intermediate slide, with which support/cocking piece 6 of the intermediate slide the pistol is cocked and the slide is moved.

The main frame 1 of the sight frame also preferably has a release opening for the casing of the round, through which the casings of the round exit as the intermediate slide and pistol slide arrive at their retracted position as a result of a shot and when the openings are on top of each other. The main frame 1 of the sight frame also preferably has edges on the top and bottom sides of the slide surface to protect the slide surface of the intermediate slide 2 from blows and dents. The main frame 1 of the sight frame also preferably has holes for the frame piece of the operating spring 11 of the turning/locking piece. The main frame 1 of the sight frame also preferably has an angle notch arranged for the locking/release claw 10 of the operating position of the turning/locking piece 3.

The main frame 1 of the sight frame also preferably has a support angle piece of the intermediate slide 2 that keeps the intermediate slide 2 at a correct height and in place on the main frame 1. Said support angle piece can be connected to the reinforcing edges of the main frame 1. The main frame 1 of the sight frame also preferably has fastening holes and fastening points for fastening the rear piece 5 and front piece 5 of the sight frame.

In the sight frame solution of the invention, the notches and lightenings of the main frame 1 can be made as required by each handgun model. The essential thing is that the intermediate slide is retained on the main frame by means of the support angle surface and the intermediate slide has a guiding slide angle that corresponds exactly to the guiding slide angle of the main frame along a major part of the length of the handgun's slide. The intermediate slide may support itself against the slide along the entire length of the handgun's slide or, alternatively, at its front and rear ends when the slide of the handgun is in its front position, or aiming position, before shooting.

The main frame 1 of the sight frame may be manufactured of hardened steel plate as shown in the figure. Alternatively, the top part of the main frame 1 of the sight frame, which contains the slide surfaces supported against the intermediate slide and top reinforcing edges and release/load opening of cartridges, is manufactured of hardened steel plate, and the rest of the frame part of the main frame 1 is manufactured using polymer or composite cast, for instance. The rear piece 5 and front piece 4 of the sight frame may then be cast during the same process as the frame part of the main frame 1 of the sight frame. The main frame 1 of the sight frame according to the invention and all the rest of the parts may be manufactured of suitable known materials by using suitable known manufacturing techniques in such a manner, however, that the manufactured parts are strong enough for the stress directed to them.

The intermediate slide 2 according to the invention may, for instance, be a groove-like part pressed of steel plate and having surfaces leaning at a certain point on the top bevels of the handgun's slide, the surfaces being at exactly the same angle as the main frame 1 of the sight frame. The slide surfaces of the intermediate slide 2 transmit the position of the pistol's slide to the main frame 1 of the sight frame, which provides maximum precision. The intermediate slide 2 preferably has support angle pieces on the bottom edge of both of its long sides.

The intermediate slide 2 preferably has an opening for the release of the casing of the round and for loading. The intermediate slide 2 may have an opening at the ejector claw. Alternatively, the intermediate slide 2 is below the slide surfaces loose enough in respect of the handgun's slide for the ejector claw to operate.

In the solution of the invention, when a handgun is set onto the sight frame 1, the slide of the handgun is at a small angle to the intermediate slide 2. The inside of the intermediate slide 2 is arranged to be slightly longer than the slide of the handgun so that the handgun fits into the intermediate slide 2. The sight frame solution according to the invention also comprises a disc spring that presses the intermediate slide play free to the pistol slide at its rear when the pistol is in its operating position on the sight frame. The disc spring yields when a handgun is mounted on the sight frame. When the handgun is locked into its operating position, the disc spring makes the intermediate slide play free at its rear end in respect of the slide of the handgun. A reinforcing part may be attached to the rear part of the intermediate slide 2 by welding, for instance.

The turning/locking piece 3 according to the invention provides a play free placement of the handgun to the sight frame 1 by means of the intermediate slide 2. The turning/locking piece 3 has a counter-groove with as small a play as possible and suitable for the trigger guard of any handgun. In the solution according to the invention, the turning/locking piece 3 is arranged to support itself against the bottom surface of the handgun's trigger guard, the bottom arc corner at the front, for instance. The bottom surface of the handgun's trigger guard is a particularly robust point of the handgun and far enough from the top parts of the handgun's slide that provide support to the intermediate slide 2 and thus also to the entire sight frame. Thus, the vertical deviation of the handgun in respect of the intermediate slide and sight frame is as small as possible.

The turning/locking piece 3 according to the invention also has grooves that make movement possible. The top groove of the turning/locking piece 3 permits movement toward the front and back and acts simultaneously as the location for the force of the operating spring 11 of the turning/locking piece in the turning axle. The bottom groove of the turning/locking piece 3 has a notch to keep the operating position open, a groove that permits the lifting of the handgun and a groove that permits moving the handgun into the retracted/operating position, which is also loose enough in respect of the guide axle 9 of the turning/locking piece. This way, the bottom groove of the turning/locking piece 3 does not hamper the play free connection of the handgun to the sight frame.

The turning/locking piece 3 according to the invention also has a front-end fastening hole of the operating spring 11 of the turning/locking piece that utilises its push and lift force. The turning/locking piece 3 may also have a notch in the middle to permit the movement of the operating spring 11 of the turning/locking piece from the front and below. Said notch may be slightly wider than the diameter of the operating spring 11 of the turning/locking piece. The turning/locking piece 3 may be slightly narrower than the shoulders of the guide axles 9 of the turning/locking piece.

The turning/locking piece 3 may be manufactured by casting or machining of steel, aluminium, aluminium alloy, polymer, composite material or some other suitable known material that is sufficiently strong.

The front piece 4 of the sight frame according to the invention stiffens the front end of the main frame against torsional forces. The front piece 4 of the sight frame may also contain a device rail for sighting devices to be attached below the barrel. The front piece 4 of the sight frame also stops gunpowder gases from spreading on the hands of the user. The front piece 4 of the sight frame may be manufactured by casting or machining of steel, aluminium, aluminium alloy, polymer, composite material or some other suitable known material that is sufficiently strong.

The rear piece 5 of the sight frame according to the invention has a bevel that supports itself against the rounding bevel of the top part of the handgun's palm part. The rear piece 5 of the sight frame lifts the handgun on the sight frame when the handgun is placed in the operating position and pulled back. The rear piece 5 of the sight frame also has lugs for the turning axle journal for turnable mounting of the folding stock 18. One of the lugs may be round in circumference and the other square, as shown in FIG. 7. The rear piece 5 of the sight frame also has a shoulder supported against the retainer/return spring 8 of the intermediate slide to keep the spring in place. The rear piece 5 of the sight frame may be manufactured by casting or machining of steel, aluminium, aluminium alloy, polymer, composite material or some other suitable known material that is sufficiently strong.

The support/cocking piece 6 of the intermediate slide strengthens the rear part of the intermediate slide 2 in such a manner that the support/cocking piece 6 of the intermediate slide is fastened to the intermediate slide 2 from the top and sides so that the support/cocking piece 6 of the intermediate slide does not hamper the contact of the slide surfaces of the intermediate slide 2 with the slide surfaces of the main frame 1 of the sight frame. The support/cocking piece 6 of the intermediate slide also has a cocking/operating level.

The retainer/return spring 8 according to the invention keeps the intermediate slide 2 in a correct position for installation. The retainer/return spring 8 compensates for the friction caused by the intermediate slide 2 and main frame 1 of the sight frame and thus ensures a flawless operation of the handgun and sight frame.

The guide axles 9 of the turning/locking piece according to the invention have lugs and determine the clearance between the main frame 1 and turning/locking piece 3 of the sight frame. The guide axles 9 of the turning/locking piece determine the paths of the turning/locking piece 3 on the sight frame.

The locking/release claw 10 of the operating position of the turning/locking piece according to the invention rises to a notch on the sight frame and bevelled on its front edge, when the handgun is pulled back to its operating position and when the turning/locking piece 3 is in its retracted position. The locking/release claw 10 of the operating position of the turning/locking piece settles against said notch by means of the bevelled surface and thus tightens the pistol to its operating position.

By pressing a press surface on the locking/release claw 10 of the operating position of the turning/locking piece according to the invention, the locking is released and the handgun may be moved along the guide grooves on the turning/locking piece 3 to an open position and removed from the sight frame.

The operating spring 11 of the turning/locking piece according to the invention consists of a push spring and a guide frame of the spring. The guide frame of the spring comprises two nested frame pieces of the spring, an inner piece and an outer piece. The stem of the inner piece of the guide frame fits into the hole of the outer piece. Correspondingly, the outer diameter of the outer piece of the guide frame is smaller than the inner diameter of the push spring. The frame pieces of the guide frame of the turning/locking piece operating spring 11 keep the operating spring 11 straight regardless of the position. This way, the operating spring 11 of the turning/locking piece cannot bend into any direction as the spring drives the turning/locking piece 3.

By means of the force acting through the turning/locking piece 3, the operating spring 11 of the turning/locking piece according to the invention keeps the handgun play free in respect of the intermediate slide 2 and also in respect of the sight frame through the intermediate slide 2.

The top fastening rail 12 of the sight frame according to the invention is primarily intended for sighting devices. The top fastening rail 12 is directly above the barrel line of the handgun, and an optical light amplification scope, for example, or some other main scope of the sight frame can be mounted on this top fastening rail 12 of the sight frame.

The side fastening rails 13 of the sight frame according to the invention are located in the front part of the sight frame on both sides of the barrel line. The side fastening rails 13 of the sight frame can be used for fastening a front handle or some other additional device.

The locking counter-piece 14 of the top fastening rail according to the invention is a threaded counter-piece that is positioned on the inner surface of the main frame 1 of the sight frame on the opposite side of the top fastening rail 12 of the sight frame. The tightening screws of the top fastening rail 12 of the sight frame tighten on the locking counter-piece 14 of the top fastening rail through alignment holes in the main frame 1 of the sight frame.

The locking counter-pieces 15 of the side fastening rails according to the invention are threaded counter-pieces that are positioned on the inner surface of the main frame 1 of the sight frame on the opposite side of the side fastening rails 13. The tightening screws of the side fastening rails 13 of the sight frame tighten on the locking counter-pieces 15 of the side fastening rails through alignment holes in the main frame 1 of the sight frame.

The locking/release sleeve 16 of the folding stock according to the invention is arranged to move sideways on the turning axle pin 19 of the folding stock. The locking/release sleeve 16 of the folding stock is guided by the straight surface of a square axle lug of the rear piece 5 of the sight frame, whereby the locking/release sleeve 16 of the folding stock cannot rotate. As the folding stock 18 moves to its operating position, the bevel on the bottom edge of the locking/release sleeve 16 of the folding stock comes against the folding stock 18 and the locking/release sleeve 16 of the folding stock moves sideways until the axle of the folding stock 18 has passed the locking/release sleeve 16 of the folding stock. After this, the locking/release sleeve 16 of the folding stock moves back to its initial position under the force of its operating spring 17 and locks the folding stock 18.

The locking/release sleeve 16 of the folding stock according to the invention also comprises an elongated press projection located on the top edge of the locking/release sleeve 16, and by pressing it, the folding stock 18 can be released and folded back to its transport position.

The operating spring 17 of the locking/release sleeve of the folding stock according to the invention pushes the locking/release sleeve 16 of the folding stock toward the square axle lug of the rear piece 5 of the sight frame, which permits the appropriate operation of the locking/release sleeve 16 of the folding stock.

The folding stock 18 according to the invention is mounted turnably on axle lugs arranged on the rear piece 5. In its operating position, the folding stock 18 is the stock part of the sight frame supported on the shoulder of the user. In its storage position, the folding stock 18 can be turned forward to rest beside the sight frame. The folding stock 18 according to the invention can be manufactured of steel or some other suitable known material that is sufficiently strong.

Figure 8:
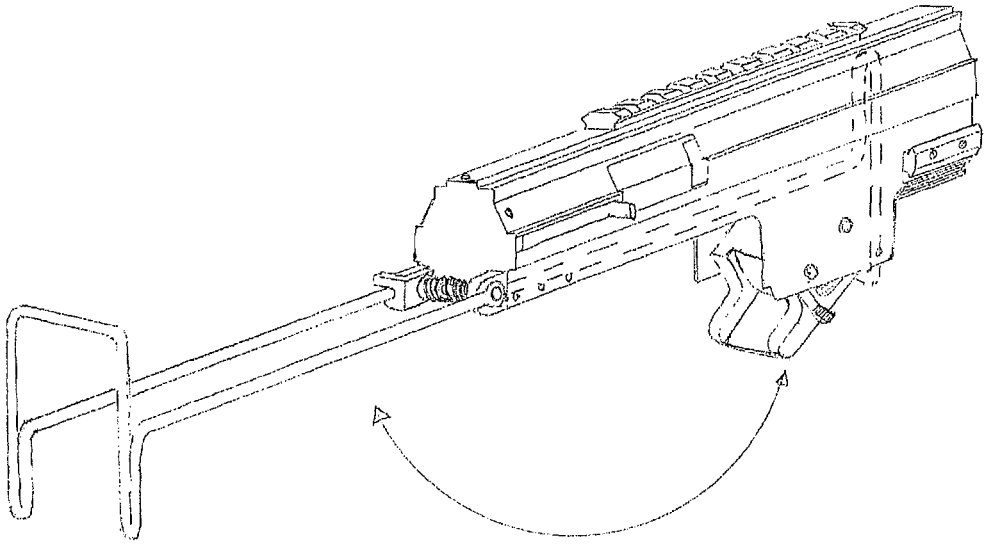
FIG. 8 shows a folding stock of a sight frame according to the invention as well as its operation.

FIG. 8 shows a folding stock of a sight frame according to an invention as well as its operation. The figure shows the sight frame of a handgun equipped with a folding stock without the handgun. In the figure, the folding stock is shown in its operating position with a uniform line and in its storage position with a dashed line.

FIG. 8 shows a folding stock according to the invention that is moved into its operating position by folding the folding stock 18 backward from below. The folding stock 18 locks into its operating position by means of the locking/release sleeve 16 on the turning axle pin 19 of the folding stock. The locking/release sleeve 16 is automatically pushed by the operating spring 17 of the locking/release sleeve of the folding stock on the locking/release sleeve 16 and turning axle pin 19. When folding the folding stock 18 into its operating position, the bevel in the bottom corner of the locking/release sleeve 16 pushes the locking/release sleeve 16 away. When the axle of the folding stock 18 passes said bevel, the locking/release sleeve 16 of the folding stock pushes outward and locks the axle of the folding stock in the groove reserved for it. The folding stock 18 can be released by pressing the elongated press projection located on the top edge of the locking/release sleeve 16 of the folding stock, after which the folding stock 18 can be folded into its storage position.

Alternatively, the stock part of the sight frame according to the invention can be implemented by means of a pullable stock part or some other known stock part solution.

Figure 9:
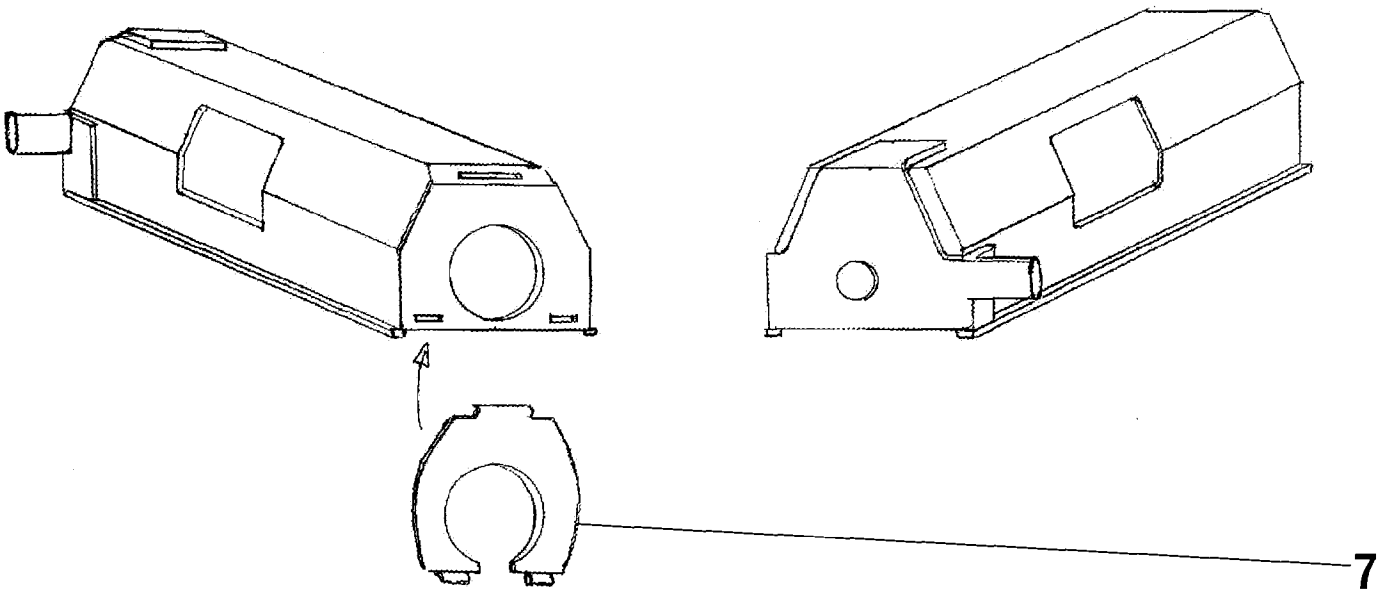
FIG. 9 shows an intermediate slide of a sight frame according to the invention obliquely from the front and back.

FIG. 9 shows an intermediate slide of a sight frame according to the invention obliquely from the front and back. The figure shows a suitably shaped disc spring 7 inside the front end of the intermediate slide. The disc spring 7 presses the intermediate slide play free to the pistol slide at its rear when the pistol is in its operating position on the sight frame. The figure also shows the support/cocking piece of the intermediate slide.

The disc spring 7 yields when a handgun is mounted on the sight frame. When the handgun is locked into its operating position, the disc spring 7 makes the intermediate slide play free at its rear end in respect of the slide of the handgun. When the slide of the pistol moves backward after firing, the intermediate slide does not receive a sharp impact but moves backward at the same speed as the slide of the pistol. A reinforcing part may be attached to the rear part of the intermediate slide by welding, for instance. The reinforcing part may also have the operating lever of the intermediate slide, by means of which the handgun can be cocked and a feed failure of the handgun can be fixed.

Figure 10:
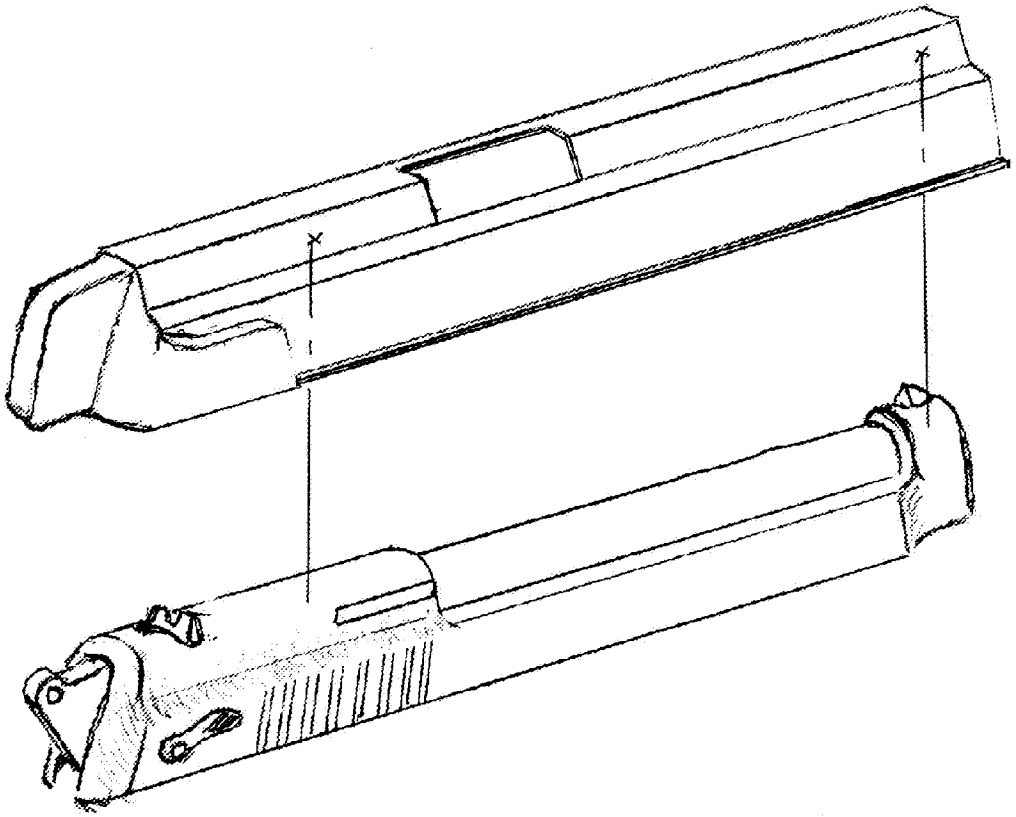
FIG. 10 shows an alternative intermediate slide of a sight frame according to the invention and a part of a handgun corresponding to the alternative intermediate slide obliquely from the front.

FIG. 10 shows an alternative intermediate slide of a sight frame according to the invention and a handgun corresponding to the alternative intermediate slide obliquely from the front. In the figure, the pistol is indicated by number 21 and the intermediate slide by number 22. FIG. 10 shows a very different type of handgun 21 equipped with a hammer and an intermediate slide 22 corresponding to this handgun. Thin lines on the figure show the place where in the slide of the handgun 21 the rigid connection enters the intermediate slide 22 and transmits on through the slide surfaces of the intermediate slide 22 to the main frame of the sight frame.

With the sight frame attachable to a handgun according to the invention, the user obtains a handgun converted into a rifle that is more precise and reliable than the earlier solutions.

The invention claimed is:

1. A method for manufacturing a handgun converter, the handgun converter comprising a sight frame attachable to a handgun, the method comprising:

the manufacturing of a frame part of the sight frame, a folding stock of the frame part, the folding stock being attachable to the frame part, an intermediate slide which is configured to be placed between the frame part and the handgun, and locking and guide structures comprising guide surfaces made on the intermediate slide and the frame part, the intermediate slide and the locking and guide structures being configured to attach the frame part to the handgun, wherein the locking and guide structures are manufactured to provide a lifting force to the handgun and the guide surfaces are provided on the frame part and the intermediate slide in such a manner that the intermediate slide is, by means of the lifting force provided by the locking and guide structures to the handgun, (i) arranged to be supported play free against a slide of the handgun along a major portion of a length of the handgun slide and (ii) further arranged to be supported through the guide surfaces of the intermediate slide play free against the guide surfaces arranged on the frame part of the sight frame, wherein the intermediate slide is a channel formed part pressed from a steel plate and has the guide surfaces leaning at a certain point on top bevels of the slide of the handgun that are essentially at the same angle as the guide surfaces arranged on the frame part of the sight frame, and wherein said locking and guide structures comprise a turning/locking piece and an operating spring that produce the lifting force on a bottom surface of a trigger guard of the handgun, the lifting force supporting the slide of the handgun play free to the intermediate slide.

2. The method as claimed in claim 1, wherein the frame part of the sight frame is made of hardened steel.

3. The method as claimed in claim 1, wherein a top part of the frame part of the sight frame is made of hardened steel and the rest of the frame part of the sight frame is made by polymer casting.

4. The method as claimed in claim 1, wherein a reinforcing part is attached to a rear part of the intermediate slide by welding.

5. The method as claimed in claim 1, wherein said turning/locking piece is made by casting or machining steel, aluminum, aluminum alloy, polymer, or composite material.

6. A handgun converter comprising:

a sight frame attachable to a handgun, the sight frame comprising a frame part, a stock which is attachable to the frame part, an intermediate slide configured to be placed between the frame part and the handgun, and locking and guide structures comprising guide surfaces made on the intermediate slide and the frame part, the locking and guide structures as well as the intermediate slide being configured for attaching the sight frame to the handgun in such a manner that the locking and guide structures are configured to provide a lifting force to the handgun, wherein the intermediate slide is, by means of the lifting force provided by the locking and guide structures to the handgun, (i) arranged to be supported play free against a slide of the handgun along a major portion of a length of the handgun slide and (ii) further arranged to be supported through the guide surfaces of the intermediate slide play free against the guide surfaces arranged on the frame part of the sight frame, wherein the intermediate slide is a channel formed part pressed from a steel plate and has the guide surfaces leaning at a certain point on the top bevels of the slide of the handgun that are essentially at the same angle as the guide surfaces arranged on the frame part of the sight frame, and wherein said locking and guide structures comprise a turning/locking piece and an operating spring that produce the lifting force on a bottom surface of a trigger guard of the handgun, the lifting force supporting the slide of the handgun play free to the intermediate slide.

7. The handgun converter as claimed in claim 6, wherein on the frame part of the sight frame, there is a support angle surface for the intermediate slide to keep the intermediate slide at the correct height and in place on the frame part.

8. The handgun converter as claimed in claim 6, wherein the sight frame comprises a front piece which front piece stiffens a front end of the frame part against torsional forces.

9. The handgun converter as claimed in claim 6, wherein the sight frame comprises a rear piece which rear piece is arranged to lift the handgun on the sight frame when the handgun is pulled back.

10. The handgun converter as claimed in claim 6, wherein the sight frame comprises fastening rails for additional devices and locking counter-pieces of the fastening rails.

11. The handgun converter as claimed in claim 6, wherein the sight frame comprises a locking/release sleeve, an operating spring of the locking/release sleeve, and a turning axle pin of the stock.

* * * * *